US011611154B2

(12) United States Patent
Dinh et al.

(10) Patent No.: US 11,611,154 B2
(45) Date of Patent: Mar. 21, 2023

(54) PRINTED IMPEDANCE TRANSFORMER FOR BROADBAND DUAL-POLARIZED ANTENNA

(71) Applicant: VIETTEL GROUP, Ha Noi (VN)

(72) Inventors: Cong Kien Dinh, Ha Noi (VN); Hoang Linh Nguyen, Ha Noi (VN); Tien Manh Nguyen, Ha Noi (VN); Ba Dat Nguyen, Ha Noi (VN)

(73) Assignee: VIETTEL GROUP, Ha Noi (VN)

( * ) Notice: Subject to any disclaimer, the term of this patent is extended or adjusted under 35 U.S.C. 154(b) by 185 days.

(21) Appl. No.: 17/137,858

(22) Filed: Dec. 30, 2020

(65) Prior Publication Data

US 2021/0273344 A1 Sep. 2, 2021

(30) Foreign Application Priority Data

Feb. 28, 2020 (VN) ..... 1-2020-01150

(51) Int. Cl.

| | |
|---|---|
| ***H01Q 9/28*** | (2006.01) |
| ***H01Q 21/00*** | (2006.01) |
| ***H01Q 19/10*** | (2006.01) |
| ***H01Q 1/38*** | (2006.01) |
| ***H01Q 21/06*** | (2006.01) |
| ***H01Q 1/24*** | (2006.01) |

(52) U.S. Cl.

CPC ..... *H01Q 21/0075* (2013.01); *H01Q 1/246* (2013.01); *H01Q 1/38* (2013.01); *H01Q 19/108* (2013.01); *H01Q 21/062* (2013.01)

(58) Field of Classification Search

CPC .... H01Q 21/0075; H01Q 19/108; H01Q 1/38; H01Q 21/062; H01Q 1/246; H01Q 21/26

See application file for complete search history.

(56) References Cited

U.S. PATENT DOCUMENTS 6,940,465 B2 * 9/2005 Gottl ..... H01Q 1/246 343/815

* cited by examiner

*Primary Examiner* — Joseph J Lauture
(74) *Attorney, Agent, or Firm* — Patenttm.US

(57) ABSTRACT

A broadband dual-polarized antenna integrated high-performance balun. The antenna structure consists of three main parts: radiator, feeding structure and reflector. The radiation element consists of four radiation parts with petal shape, forming two pairs of orthogonal dipole antennas. The feeding structure consists of four circuit boards with separated lines, forming resonant structures corresponding to a balance transformer. The reflector enables to direct the beam, increasing the antenna's orientation.

2 Claims, 4 Drawing Sheets

PRINTED IMPEDANCE TRANSFORMER FOR BROADBAND DUAL-POLARIZED ANTENNA

FIELD OF THE INVENTION

The invention refers to a printed impedance transformer for broadband dual-polarized antenna. Specifically, the antennas are employed in for commercial and military applications of broadband transceivers. The proposed antenna can be applied to fabricate phase array antennas in the 5G base station and in the receiver of spectrum surveillance systems.

DESCRIPTION OF THE RELATED ART

In recent years, with the development of communications, there is a demand for antennas with new designs, meeting criteria such as: broadband, high gain, compact size, low reflection coefficient. Several solutions are offered to meet the mentioned requirements.

There are several types of antenna that are widely used for communication and spectrum surveillance, but they still have some disadvantages. Despite their wide frequency range, log-periodic antennas are relatively large in size and the center phase of the antenna changes with each frequency. Therefore, these antennas are not yet suitable for receiving and locating broadband signals. A dipole antenna is also used in some systems, however, this type of antenna has a narrow bandwidth. Another type of dipole antenna is developed based on the principle of combining emitting elements of different lengths to overcome narrow bandwidth disadvantages. However, these antennas are normally energized by two parallel coaxial cables with a two-pole phase difference of 180 degrees, so a phase compensation device is required for the antenna. Microstrip antenna, which is low profile, low cost, lightweight and easy to fabricate, is another solution, but its bandwidth is also limited.

The dual-polarized antenna with a four-petal radiator has some advantages such as wide-band, uniform gain and uniform waveform over a wide frequency range. Typically, all four radiators will be fed by four coaxial cables in turn, the other ends of the cable connected to balun or detachable couplers to convert from differential signals to single port signal. This feeding makes the antenna structure cumbersome and expensive.

In this invention, a new antenna design is proposed using a simple feeding structure made of printed circuit boards. The proposed antenna has a feeding structure that operates like an impedance transformer or a balun between the 50Ω input port and the radiator.

SUMMARY OF THE INVENTION

The purpose of the invention is to propose a broadband dual-polarized antenna with the feeding structure operating as a balance transformer. This antenna is designed based on the structure of a four petal-shaped combined with the new feeding part.

To achieve the above targets, the proposed antennas include: the radiator, the feeding structure (balance transformer) and the reflector.

This invention proposes a dual-polarized antenna with Γ-shaped baluns entirely fabricated using printed-circuit boards instead of a coaxial cable. This structure allows the antenna to be compact as there is no need for additional phase compensation for the two poles.

DETAILED DESCRIPTION

Figure 1:
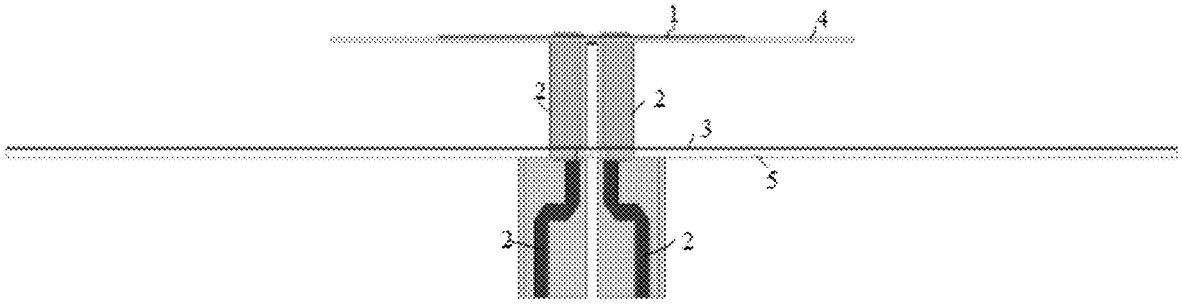
FIG. 1 illustrates the side view of the antenna.

The proposed antenna has the following structure: radiator (1), the integrated balun (2), reflector (3). Additionally, there are also a number of auxiliary components such as dielectric substrates (4), (5), circuit line (6) and outer side of the circuit board (7).

Figure 2:
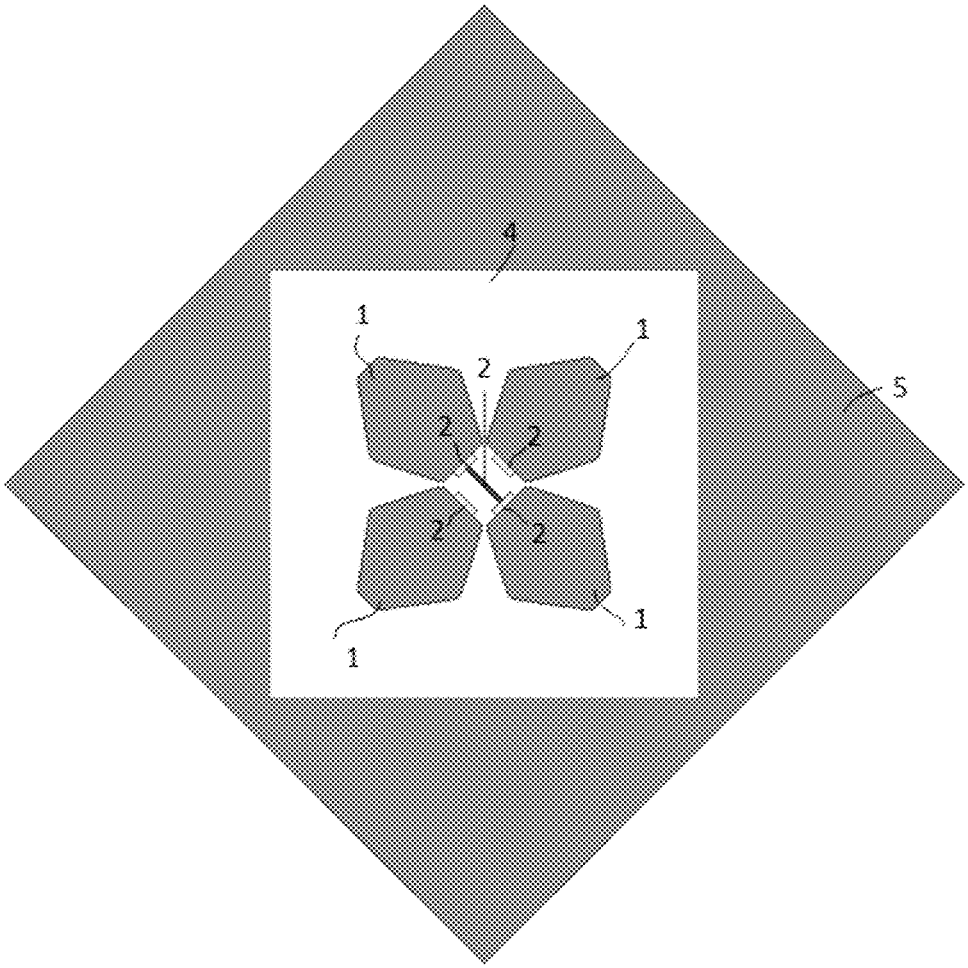
FIG. 2 illustrates the top view of the radiator.

The radiating structure of the antenna shown in FIG. 2 consists of four identical, petal-shaped thin metal plates lying symmetrically across two orthogonal axes and a center of symmetry. The two opposite metal plates form a dipole antenna. Radiator (1) has the shape of a four-petals flower, the corners of the radiator are cut in a rounded shape. The structure of the radiator is curves creating multiple half-wavelength resonance segments to expand the bandwidth.

Radiator (1) is printed on substrate (4) which is Rogers material RT5880 due to this material has low relative permittivity and low loss tangent. In addition, the thickness of the substrate of the antenna should be thin to reduce the dielectric loss.

Radiator (1) is mounted above the ground with the height of a quarter of wavelength referring to the center frequency of the operating band. This reflector is printed on a dielectric substrate (5).

Figure 3:
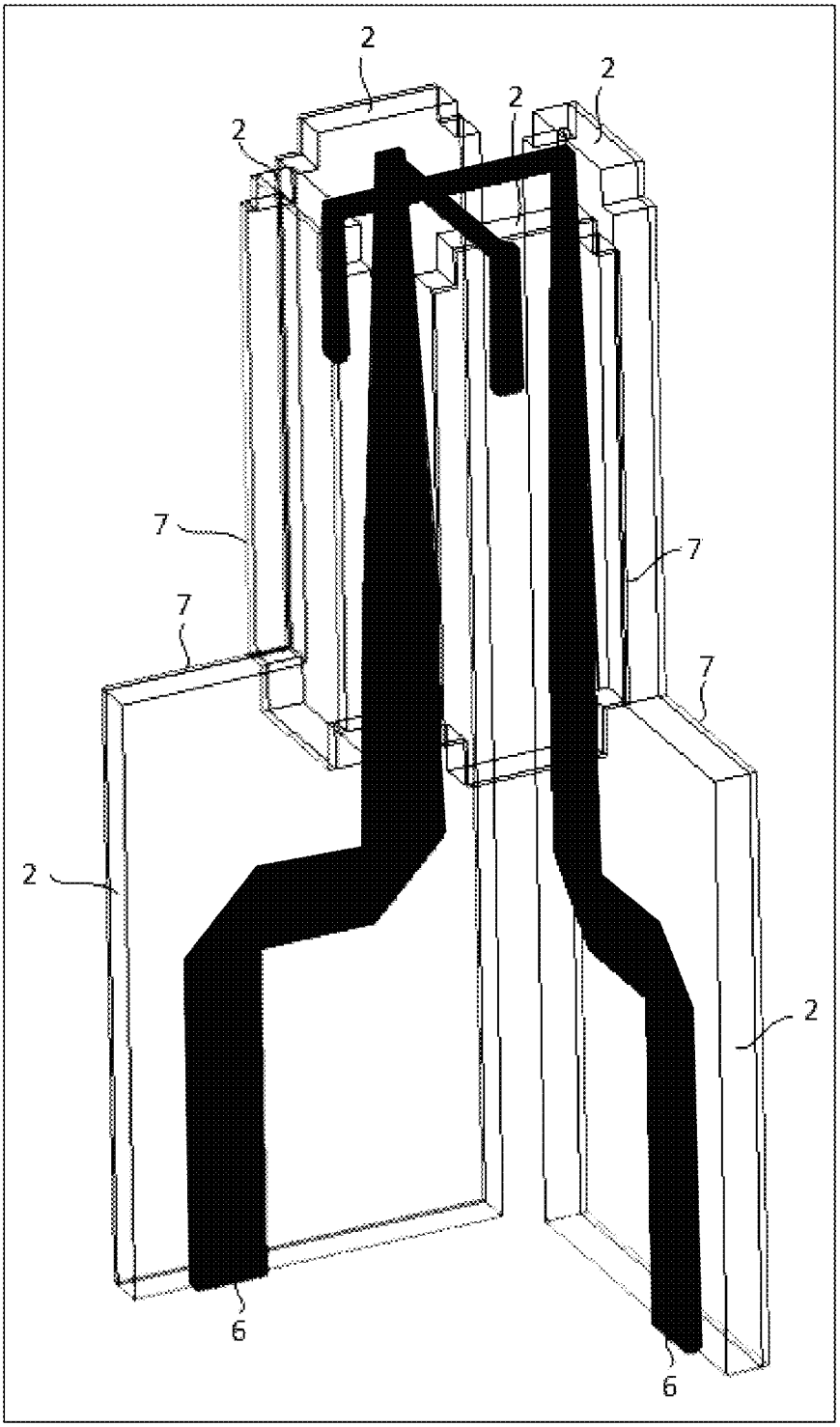
FIG. 3 illustrates a one-sided antenna structure of a contacted antenna.

In the FIG. 3, the feeding structure consists of four stem boards, in which the copper lines (6) are printed on two sides of each board. The structure that combines the microstrip lines and the radiator forms a balance transformer. Each pair of radiator wings is welded with the outer surface of the corresponding stem board. They become a resonant structure in the form of a parallel two-plane waveguide that is short-circuited at the terminal. The microstrip line on the inside of the circuit board combined with the conducting line located on the radiator plane forms a resonant Γ-shaped structure. The two resonant structures combine through mutuality, converting a balanced signal on each pair of radiators to an unbalanced signal at the antenna output.

Figure 4:
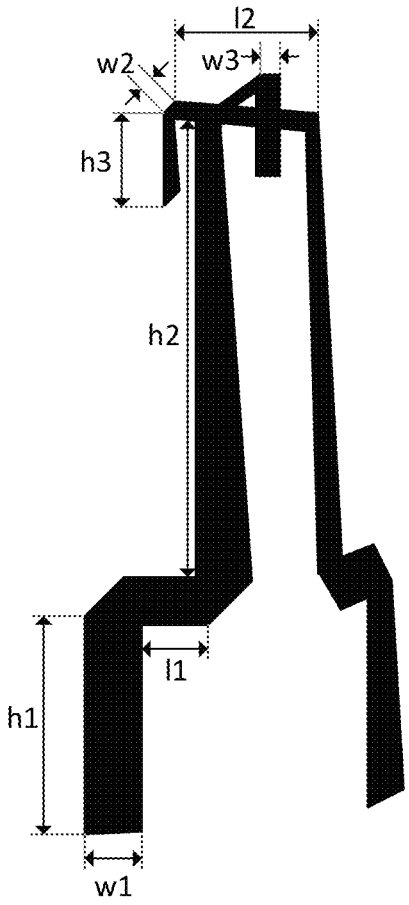
FIG. 4 illustrates the side view of the balun.

The structure and dimensions of the balun are showed in FIGS. 3 and 4. The transmission line is designed on a microstrip circuit printed on the RO4350B substrate with a dielectric constant of $\varepsilon_r$=3.48, loss tangent of 0.0037 and the thickness of 30 mils. With the transmission structure in the present invention, the line size corresponding to the 50Ω impedance is $w_2$=0.9 mm. An impedance matching line of length $h_2$=13.2 mm coordinates the impedance from a position with 100Ω to the position with 50Ω impedance. The line width at the 100Ω impedance position is $w_1$=0.5 mm. Dimensions of the feeding part are listed detail in Table 1.

TABLE 1

| Dimensions of the Γ-shaped balun. Dimensions of the Γ-shaped balun (unit: mm) | | | | | | | |
|---|---|---|---|---|---|---|---|
| $w_1$ | $w_2$ | $w_3$ | $h_1$ | $h_2$ | $h_3$ | $l_1$ | $l_2$ |
| 1.8 | 0.5 | 0.4 | 5 | 13.2 | 3 | 5.2 | 6.3 |

Reflector (3) is structured as a square cut with 4 slots in the middle, just enough for the balun (2) to pass through. Reflector (3) allows the antenna to focus radiant energy in a direction perpendicular to the reflector, so the antenna will have a high gain.

As simultaneously fed by two ports, the antennas operate in two polarizations orthogonal to each other. By feeding in pairs, the signal on copper line (6) has the same phase and amplitude. The antenna, therefore, does not need additional phase compensation, reducing the complexity and equipment of the antenna system.

Execution Example

Figure 5:
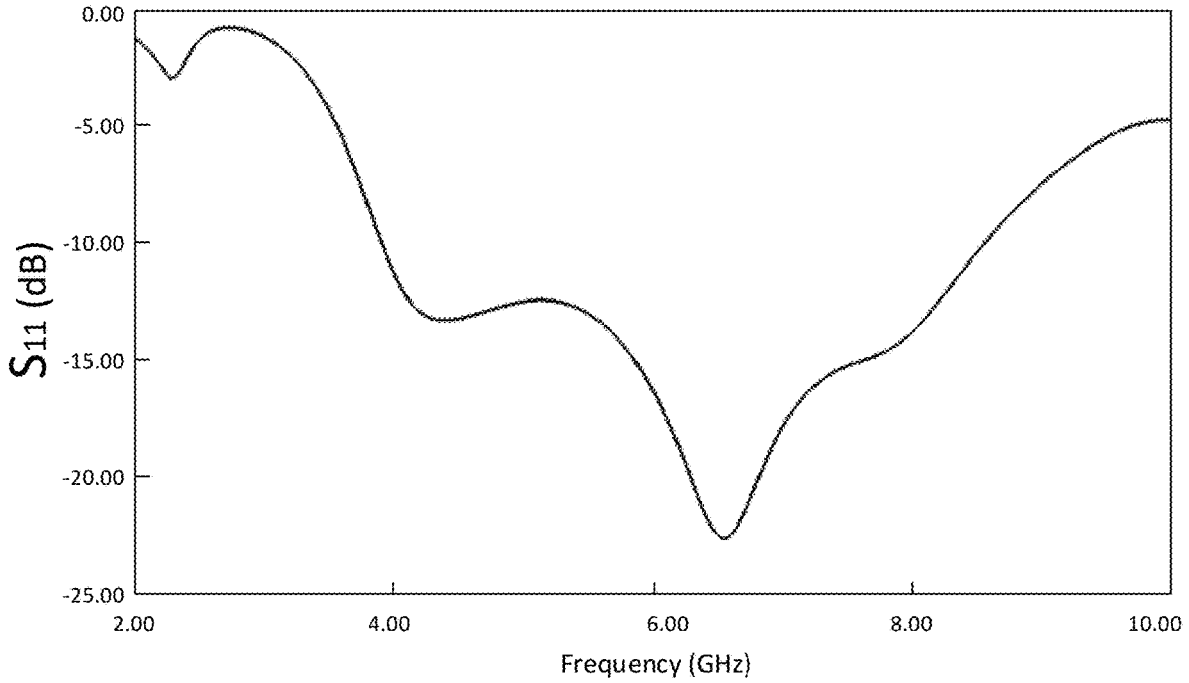
FIG. 5 is the result of reflector coefficient.

FIG. 5 shows the reflector coefficient in the operating frequency range 4-8 GHz. The reflector coefficient is the ratio of the incident power to the reflected power when an antenna is fed at a particular port. As shown in FIG. 5, the reflector coefficient is lower than −10 dB over the operating frequency range. A low reflection coefficient indicates a good level of impedance matching between the radiator and feeding structure.

Figure 6:
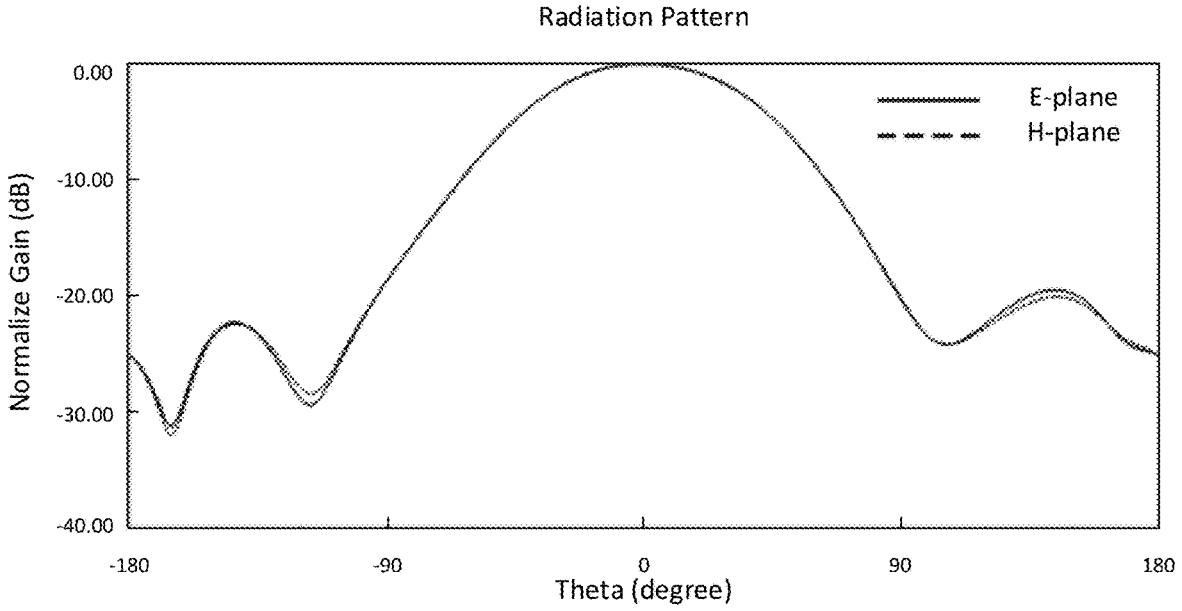
FIG. 6 shows the radiation pattern of the proposed antenna.

FIG. 6 illustrates the radiation pattern of the antenna in the E-plane and H-plane at 6 GHz. Radiation pattern refers to the directional (angular) dependence of the strength of the radio waves from the antenna. The antennas, which are applied for the spectrum surveillance system, have a large open angle on the radiation pattern to be able to receive signals over a wide region. Realizing that the opening angle at the half-power level is 72 degrees, which is relatively large to ensure wide-angle reception and transmission.

The invention claimed is:

1. Broadband dual-polarized antenna with a impedance transformer integrated balun structure, comprising:

a radiating element consisting of four copper plates which have the same petal shape and size, the copper plates are symmetrical and composed of two pairs of orthogonal dipole antennas, wherein the four copper plates are printed on a 0.508 mm thickness substrate made of rogers duroid 5880 material with a dielectric constant of 2.2 and a loss tangent of 0.0009;

a feeding structure that consists of four stem boards made of RO4350B, with a dielectric constant of 3.48 and a loss tangent of 0.0037; wherein the four stem boards comprise copper lines printed on two sides of each board; the four stem boards and the radiating element are linked together by welds between the copper plates and the copper lines on the outer side of the each stem boards; wherein the feeding structure acts as a balance transformer, where the performance of the balance transformer is characterized by the shape and size of the copper lines printed on the four stem boards; and a reflector comprising a copper plate on a reflector substrate, the reflector's structure is a square with four mid-slits cut just enough for the feeding structure to pass; the reflector helps the antenna to focus radiant energy in a direction perpendicular to the reflector, so the antenna will have a higher gain.

2. A broadband dual-polarized antennas with a high-performance balun comprising: each of a pair of radiators welded to an outside of corresponding stem boards, forming a resonant structure in a form of a parallel two-plane waveguide short-circuited at a terminal; copper lines being on an inside of two orthogonal pair of the stem boards combined with conducting lines located on planes of a radiator substrate form a resonant gamma-shaped structure; these two resonant structures combine through mutuality, converting a balanced signal on each pair of radiators to an unbalanced signal at an antenna output.

* * * * *